US012162077B2

(12) United States Patent
Murata et al.

(10) Patent No.: US 12,162,077 B2
(45) Date of Patent: Dec. 10, 2024

(54) METHOD OF PRODUCING HIGHLY CRYSTALLINE SILVER MICROPARTICLES

(71) Applicant: M. TECHNIQUE CO., LTD., Izumi (JP)

(72) Inventors: Yasunari Murata, Izumi (JP); Masakazu Enomura, Izumi (JP)

(73) Assignee: M. TECHNIQUE CO., LTD., Izumi (JP)

( * ) Notice: Subject to any disclaimer, the term of this patent is extended or adjusted under 35 U.S.C. 154(b) by 774 days.

(21) Appl. No.: 16/482,202

(22) PCT Filed: Jan. 17, 2018

(86) PCT No.: PCT/JP2018/001287
§ 371 (c)(1),
(2) Date: Jul. 30, 2019

(87) PCT Pub. No.: WO2018/142943
PCT Pub. Date: Aug. 9, 2018

(65) Prior Publication Data

US 2019/0344354 A1 Nov. 14, 2019

(30) Foreign Application Priority Data

Jan. 31, 2017 (JP) ..... 2017-016067

(51) Int. Cl.
*B22F 9/24* (2006.01)
*B22F 1/05* (2022.01)
*B22F 1/0545* (2022.01)

(52) U.S. Cl.
CPC ..... *B22F 9/24* (2013.01); *B22F 1/05* (2022.01); *B22F 1/0545* (2022.01); *B22F 2301/255* (2013.01); *B22F 2304/058* (2013.01)

(58) Field of Classification Search
None
See application file for complete search history.

(56) References Cited

U.S. PATENT DOCUMENTS

2005/0229747 A1* 10/2005 Ding ..... C30B 29/10 75/427
2005/0266311 A1* 12/2005 Tanoue ..... H01M 4/34 429/219

(Continued)

FOREIGN PATENT DOCUMENTS

JP 2003-268423 A 9/2003
JP 2006-183072 A 7/2006

(Continued)

OTHER PUBLICATIONS

English translation of JP 2008-050697 (originally published Mar. 6, 2008) from Espacenet.*

(Continued)

*Primary Examiner* — George Wyszomierski
(74) *Attorney, Agent, or Firm* — Birch, Stewart, Kolasch & Birch, LLP

(57) ABSTRACT

The present invention is a method of producing highly crystalline silver microparticles by a reduction reaction, which comprises precipitating the silver microparticles by reacting a silver solution containing at least silver ions and a reducing agent solution containing at least a reducing agent by a continuous wet reduction method, wherein a reduction rate from the silver solution to the silver microparticles is 99% or more; an average primary particle diameter of the silver microparticles is 100 nm or more and 1,000 nm or less; and an average crystallite diameter relative to the average primary particle diameter of the silver microparticles is 80% or more. Even highly crystalline silver microparticles having 95% or more of the ratio (d/D) of the average crystallite diameter (d) relative to the average primary particle diameter (D), that is, silver microparticles in which almost all silver microparticles are single crystals, (Continued)

can be continuously produced by a liquid phase method, by the present invention.

2 Claims, 4 Drawing Sheets

(56) References Cited

U.S. PATENT DOCUMENTS

| | | | |
|---|---|---|---|
| 2010/0009191 | A1 | 1/2010 | Kuba et al. |
| 2010/0327236 | A1 | 12/2010 | Enomura |
| 2013/0059161 | A1 | 3/2013 | Akimoto et al. |
| 2014/0217333 | A1 | 8/2014 | Wang et al. |
| 2015/0283616 | A1 | 10/2015 | Maekawa et al. |

FOREIGN PATENT DOCUMENTS

| | | | |
|---|---|---|---|
| JP | 2008-50697 | A | 3/2008 |
| JP | 2009-144250 | A | 7/2009 |
| JP | 2013-23699 | A | 2/2013 |
| JP | 2013-53328 | A | 3/2013 |
| TW | 201247859 | A1 | 12/2012 |
| WO | WO 2008/013274 | A1 | 1/2008 |
| WO | WO 2014/042227 | A1 | 3/2014 |

OTHER PUBLICATIONS

International Search Report (PCT/ISA/210) issued in PCT/JP2018/001287, dated Mar. 6, 2018.

Extended European Search Report for European Application No. 18748227.8, dated Jul. 21, 2020.

Chinese Office Action and Search Report for corresponding Chinese Application No. 201880009446.7, dated Nov. 29, 2021, with English translation.

Chinese Office Action for Chinese Application No. 201880009446.7, dated Jun. 22, 2022, with English translation.

* cited by examiner

METHOD OF PRODUCING HIGHLY CRYSTALLINE SILVER MICROPARTICLES

TECHNICAL FIELD

The present invention relates to a method of producing highly crystalline silver microparticles.

BACKGROUND ART

Silver is used in a wide range of fields, such as a medicine field and electronic device material field, since it has an antimicrobial and antibacterial action and excellent conductive properties. In addition, micronization of silver expresses functions such as lowering of the melting point, which are not confirmed in the bulk state, so that applications thereof are further expanded.

In particular, with regard to silver microparticles used as electronic device materials, cracks accompanied by sintering and migration that may occur by electrical conduction and the like are considered as problems. Highly crystalline silver microparticles effective against these problems are required.

Among them, silver microparticles of 100 nm or less are suitable for drawing micro wiring and the like by utilizing the above described lowering of the melting point. However, highly crystalline silver microparticles of 100 nm or more have higher effects for the above cracks and migration than highly crystalline silver microparticles of 100 nm or less. Therefore, in some cases, the highly crystalline silver microparticles of 100 nm or more may be expected as a material that has high reliabilities without structural defects and achieves low resistance.

Though it is usually difficult to obtain high crystallinity in large particles of 100 nm or more, high crystallinity tends to be obtained in general by a gas phase reaction, which is often used for producing highly crystalline silver microparticles.

For example, Patent Literature 1 discloses a method of producing highly crystalline silver powders by crushing silver carbonate powders by an air flow crusher, and blowing out a small amount of the crushed silver carbonate powders accompanying with a large amount of air from a nozzle whose peripheral portion is heated by burning a mixture of city gas and air with a burner, to produce silver powders. However, the method of Patent Literature 1 requires a large amount of energy consumption in producing silver powders, and needs a large cost, due to heating the nozzle with a burner, and an electric furnace installed outside the reaction vessel.

The above described gas phase reaction has significantly lower production efficiency than a liquid phase reaction. Therefore, it is desired to produce highly crystalline silver microparticles by a liquid phase reaction.

A significant difference between a liquid phase reaction and a gas phase reaction is that in case of a metal reduction reaction, a solute of the reduction reaction subject is surrounded by solvent molecules that are not directly involved in the reaction. Solute A repeatedly collides with solvent molecules and continues to move with intricately changing the direction until it encounters solute B of the reaction subject. Such molecule movement is called diffusion. A liquid phase reaction takes more time than a gas phase reaction due to intervention of solvent molecules until solute molecule A approaches solute molecule B. But, once solute molecule A encounters solute molecule B, the state where the solute molecules are difficult to separate from each other may continue for a while due to intervention of solvent molecules (cage effect), and thereby a controllable reaction can be realized.

The reduction reaction of precipitating silver microparticles can be considered to be separated into two steps: step 1 of diffusion until a silver ion encounters a reducing agent molecule, and step 2 of a reaction of reducing the silver ion to form silver microparticles. In the case where the rate of the reaction of the step 2 of reducing the silver ion to form silver microparticles is sufficiently fast, the rate of diffusion where a silver ion encounters a reducing agent molecule, determines the rate of the reduction reaction (diffusion control). In the case of diffusion control, when the diffusion rate increases, the rate of the reaction until all silver ions are reduced to silver microparticles increases, and when the diffusion rate decreases, the reaction rate decreases. Accordingly, the reaction rate can be controlled.

However, as described in Patent Literature 2, even in the liquid phase reaction excellent for reaction efficiency, as the silver reduction reaction proceeds in a simple batch production method, the concentrations of silver ions and the reducing agent in the reaction liquid become lower, and the silver reduction reaction becomes difficult to occur. Therefore, the silver reduction rate is lowered, and it is difficult to have a yield of the reduction reaction to be 85% or more.

Patent Literature 2 discloses a method of producing silver microparticles at an extremely high reduction rate such as a yield of 99.5% or more, by the presence of a water soluble organic solvent in the reaction liquid. Patent Literature 3 discloses a method of producing silver microparticles at an extremely high reduction rate such as a yield of 99.5% or more, by using a microwave to obtain silver microparticles. Both production methods give silver microparticles having a particle diameter of about 15 nm or less. Further, Patent Literature 4 discloses a method of producing silver microparticles in a yield of 99% or more by precipitating silver microparticles by combining an aqueous silver amine complex solution and a reducing agent solution under an open space. However, the silver microparticles produced by the spray method as in Patent Literature 4 have a large variation in the particle size distribution, and do not have a high crystallinity of 80% or more of the ratio of the average crystallite diameter relative to the average primary particle diameter, unlike the silver microparticles produced in a liquid phase as in the present invention. Accordingly, silver microparticles having a particle diameter of 100 nm or less and silver microparticles having low crystallinity can be produced at a high reduction rate. However, a high reduction rate is difficult to be achieved in the case of producing highly crystalline silver microparticles having the average primary particle diameter of 100 nm or more and a high crystallinity.

On the other hand, Patent Literature 5 filed by the present applicant discloses a method of producing silver microparticles by introducing at least two solutions into the space between the first and second processing surfaces being capable of approaching to and separating from each other and rotating relative to each other using the fluid processing apparatus described in Patent Literature 5; combining the at least two solutions in the space between the first and second processing surfaces; forming a thin film fluid by passing the at least two solutions in the space between the first and second processing surfaces; and reacting the at least two solutions with each other in the thin film fluid to precipitate silver microparticles.

When performing a continuous wet reaction in the above thin film fluid as a reaction field, the reaction space in the rotation shaft direction as shown in FIG. 1 is forced to have a minute spacing of, for example, 0.1 mm or less, while a very wide flow field is formed between the first and second processing surfaces in the direction perpendicular to the rotation shaft, so that the diffusion direction can be controlled macroscopically. Even in this case, the microscopic diffusion direction at the molecular level is turbulent as schematically shown by the arrow Y of the molecule M in FIG. 2.

According to this method, silver microparticles can be precipitated while keeping the reduction reaction field constant at all times, unlike a simple batch type production method. However, problems still remain for producing highly crystalline silver microparticles, as shown below.

For example, in Patent Literature 5, a reducing agent solution containing a reducing agent is the main stream, and is introduced from the side closer to the rotation shaft on the processing surface. In this case, silver ions are diffused in the reducing agent solution, and are reduced simultaneously at introducing the silver ions between the processing surfaces, so that the reduction reaction proceeds rapidly. On the other hand, many seed crystals are generated, and polycrystals are formed under the influence of the diffusion to the uneven surface, etc. Therefore, there is a problem that silver microparticles having high crystallization close to single crystals cannot be obtained.

Therefore, in Patent Literature 6 filed by the present applicant, the silver solution containing silver ions is set as the main stream among the silver solution and the reducing agent solution containing a reducing agent in order to improve crystallinity of silver microparticles to be precipitated. However, in the method of Patent Literature 6, ethylene glycol which exhibits reducibility to silver, is used as a main solvent of the silver solution in order to improve the rate of the reduction reaction of the silver microparticles, and thereby many seed crystals are still generated. The method has a problem that it is difficult to produce silver microparticles in which the primary particle diameter is 100 nm or more, and the ratio of the average crystallite diameter to the average primary particle diameter is 80% or more.

CITATION LIST

Patent Literature

Patent Literature 1: JP 2013-53328
Patent Literature 2: JP 2003-268423
Patent Literature 3: JP 2013-23699
Patent Literature 4: JP 2008-050697
Patent Literature 5: JP 2009-144250
Patent Literature 6: WO 2014/042227

SUMMARY OF THE INVENTION

Technical Problem

An object of the present invention is to produce highly crystalline silver microparticles by reacting a silver solution containing at least silver ions and a reducing agent solution containing at least a reducing agent by a continuous wet reduction method at an extremely high reduction rate of 99% or more from the silver solution to the silver microparticles, wherein an average primary particle diameter of the precipitated silver microparticles is 100 nm or more and 1,000 nm or less, and a ratio of an average crystallite diameter to the average primary particle diameter is 80% or more.

Solution to the Problem

The present invention is a method of producing highly crystalline silver microparticles by a continuous wet reduction method, which comprises producing the silver microparticles by reacting a silver solution containing at least silver ions and a reducing agent solution containing at least a reducing agent, wherein a reduction rate from the silver solution to the silver microparticles is 99% or more; an average primary particle diameter of the silver microparticles is 100 nm or more and 1,000 nm or less; and an average crystallite diameter relative to the average primary particle diameter of the silver microparticles is 80% or more.

Further, the present invention is preferably a method wherein the silver microparticles are precipitated by mixing the silver solution and the reducing agent solution in a reaction field in a thin film fluid formed between two processing surfaces disposed opposite to each other and being capable of approaching to and separating from each other in which at least one of the processing surfaces rotates relative to the other.

Furthermore, the present invention is preferably a method wherein the silver solution does not substantially contain a complexing agent for silver or a reducing agent for silver; and the silver solution is the main stream and a solution to be diffused, and the reducing agent solution containing a reducing agent is actively diffused in the solution to be diffused, in the reaction field in the thin film fluid formed between two processing surfaces disposed opposite to each other and being capable of approaching to and separating from each other in which at least one of the processing surfaces rotates relative to the other. Thereby, the diffusion conditions in the reaction field can be controlled more strictly, and the diffusion conditions of the reducing agent solution to the solution to be diffused can controlled. Therefore, the present invention contributes to improvement of the reduction rate from the silver solution to the silver microparticles, and improvement of the average crystallite diameter relative to the average primary particle diameter of the obtained silver microparticles.

Advantageous Effects of the Invention

The method of producing silver microparticles of the present invention can provide a method of producing silver microparticles, which comprises precipitating the silver microparticles by reacting a silver solution containing silver ions and a reducing agent solution containing at least a reducing agent by a continuous wet reduction method, by which highly crystalline silver microparticles having 100 nm or more and 1,000 nm or less of an average primary particle diameter, and having 80% or more of a ratio (d/D) of an average crystallite diameter (d) relative to the average primary particle diameter (D), can be produced efficiently at a high reduction rate of 99% or more. In particular, the effect is great that highly crystalline silver microparticles having 100 nm or more of an average primary particle diameter, and having 80% or more of an average crystallite diameter relative to the average primary particle diameter, can be continuously produced by a wet method, while the silver microparticles are difficult to be produced by a liquid phase method. The present invention contributes to improvement of a production efficiency of highly crystalline silver microparticles. Furthermore, even highly crystalline silver microparticles having 95% or more of the ratio (d/D) of the average crystallite diameter (d) relative to the average primary particle diameter (D), that is, silver microparticles in which almost all silver microparticles are single crystals, can be continuously produced by a liquid phase method, by the way that the silver solution does not substantially contain a complexing agent for silver or a reducing agent for silver;

and the silver solution is the main stream and a solution to be diffused in the thin film fluid, and the reducing agent solution is actively diffused in the solution to be diffused, in the reaction field formed as the thin film fluid.

DESCRIPTION OF THE INVENTION

Figure 1:
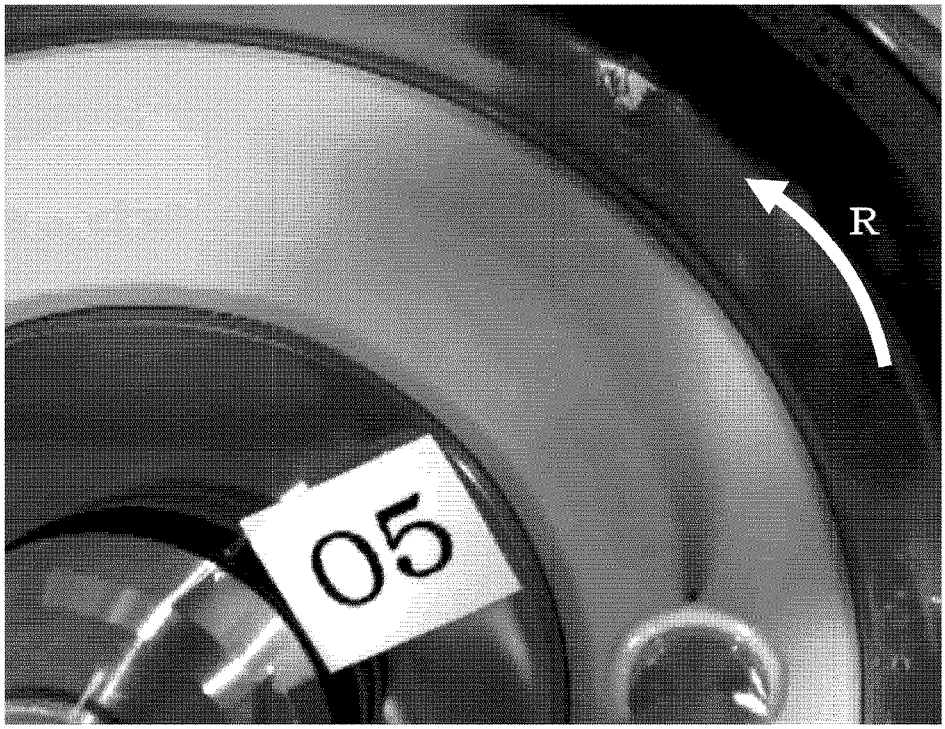
FIG. 1 shows an actual photograph showing the macroscopic diffusion direction in the reaction field in the thin film space.

Hereinafter, the method of producing silver microparticles of the present invention is explained in detail with reference to embodiments as an example. It should be noted that the scope of the present invention is not limited to only the embodiments and examples described below.

In the present invention, provided is a method of producing silver microparticles in which silver microparticles are precipitated by reducing silver ions contained in a solution with a reducing agent, wherein an average crystallite diameter relative to an average primary particle diameter of the silver microparticles is 80% or more. In particular, provided is a method of producing silver microparticles having a particle diameter of 100 nm or more at a reduction rate of 99% or more by a continuous wet reaction, wherein an average crystallite diameter relative to the average primary particle diameter of the silver microparticles is 80% or more. The silver microparticles obtained by the present invention have a particle diameter of 100 nm or more and 1,000 nm or less, preferably 300 nm or more and 1,000 nm or less, and more preferably 500 nm or more and 1,000 nm or less. Furthermore, the average crystallite diameter relative to the average primary particle diameter of the obtained silver microparticles is 80% or more, preferably 90% or more, and more preferably 95% or more. The upper limit of the particle diameter of the silver microparticles has been set to 1,000 nm, because a method of calculating a crystallite diameter of highly crystalline silver microparticles having a crystallite diameter of 1,000 nm or more has not been established. However, the present inventors believe that even silver microparticles having 80% or more of an average crystallite diameter relative to the average primary particle diameter and 1,000 nm or more of a particle diameter can be produced, by using the method of producing silver microparticles of the present invention.

In the present invention, silver microparticles are precipitated by mixing a silver solution containing at least silver ions and a reducing agent solution containing at least a reducing agent. As an example in embodiments, silver or a silver compound and a reducing agent are respectively dissolved or molecularly dispersed in a solvent to prepare the above two kinds of solutions, and silver microparticles are precipitated by mixing the above two kinds of solutions.

(Silver Compound)

The silver ions in the present invention are contained in a silver solution obtained by dissolving or molecularly dispersing silver or a silver compound in a solvent described later. Examples of the above silver or silver compound include a single element of silver, or a salt, an oxide, a hydroxide, a hydroxide oxide, a nitride, a carbide, an organic salt, an organic complex, an organic compound of silver, or a hydrate thereof, an organic solvate thereof, and the like. A silver salt is not particularly limited, but includes a nitrate, a nitrite, a sulfate, a sulfite, a formate, an acetate, a phosphate, a phosphite, a hypophosphite, a chloride, an oxy salt, an acetylacetonate of silver, or a hydrate thereof, an organic solvate thereof and the like. These silver compounds may be used alone, or a mixture of a plurality of these compounds may be used.

The concentration of the silver compound in the silver solution is not particularly limited as long as it can uniformly react with the reducing agent. For example, the concentration is 0.01 to 10 wt %, preferably 0.1 to 5 wt %, more preferably 0.2 to 4 wt %, still more preferably 0.3 to 3 wt %, and particularly preferably 0.4 to 2 wt %.

(Reducing Agent Solution)

The reducing agent solution in the present invention is a solution containing a reducing agent which exhibits reducibility to silver, and is a liquid reducing agent or a reducing agent solution obtained by dissolving or molecularly dispersing a reducing agent in a solvent described later. The substance exhibiting reducibility to silver is not particularly limited. Examples of the reducing agent include a hydrazine such as hydrazine, hydrazine monohydrate, hydrazine sulfate and phenylhydrazine; an amine such as dimethylaminoethanol, triethylamine, octylamine and dimethylaminoborane; an organic acid such as citric acid, ascorbic acid, tartaric acid, malic acid, malonic acid, tannic acid, formic acid and their salts; a monoalcohol including an aliphatic monoalcohol such as methanol, ethanol, isopropyl alcohol and butanol, and an alicyclic monoalcohol such as terpineol; and a polyhydric alcohol such as ethylene glycol, diethylene glycol, triethylene glycol, propylene glycol, dipropylene glycol, glycerin, trimethylolpropane, tetraethylene glycol, benzotriazole, polyethylene glycol and polypropylene glycol. Also, examples of the reducing agent include a hydride such as sodium borohydride, lithium borohydride, lithium triethylborohydride, lithium aluminum hydride, diisobutylaluminum hydride, tributyltin hydride, lithium tri(sec-butyl) borohydride, potassium tri(sec-butyl)hydride, tetrabutylammonium borohydride, zinc borohydride, sodium acetoxyborohydride; a saccharide such as glucose; formaldehyde, sodium formaldehyde sulfoxylate, sodium hypophosphite ($NaH_2PO_2$); a salt of transition metals (titanium or iron) such as iron sulfate, etc. and a hydrate thereof and a solvate thereof. These reducing agents may be used alone or in combination of two or more. When using a reducing agent that requires securing of a certain pH range in the reduction, a pH adjusting substance may be used in combination with the reducing agent. Examples of the pH adjusting substance include an acidic substance including an inorganic or organic acid such as hydrochloric acid, sulfuric acid, nitric acid or aqua regia, trichloroacetic acid, trifluoroacetic acid, phosphoric acid, citric acid, ascorbic acid; a basic substance including an alkali hydroxide such as sodium hydroxide and potassium hydroxide, and an amine such as triethylamine and dimethylaminoethanol; and a salt of the above acidic substance and basic substance. The pH adjusting substance may be used alone or in combination of two or more.

The reducing agent is used in excess to the silver compound in order to improve the reduction rate of the silver compound. The concentration of the reducing agent in the reducing agent solution is not particularly limited, but is, for example, 1 to 80 wt %, preferably 2 to 50 wt %, more preferably 5 to 40 wt %, particularly preferably 10 to 30 wt %.

A solvent which can be used for the above silver solution or reducing agent solution in the present invention is not particularly limited, but includes water such as ion exchanged water, RO water (reverse osmosis water), pure water and ultrapure water; a ketone organic solvent such as acetone and methyl ethyl ketone; an ester organic solvent such as ethyl acetate and butyl acetate; an ether organic solvent such as dimethyl ether and dibutyl ether; an aromatic organic solvent such as benzene, toluene and xylene; an aliphatic hydrocarbon organic solvent such as hexane and pentane and the like. The solvent may be used alone or in combination of two or more. Preferred solvents include water. Dissolved oxygen is preferably degassed from the solvent. Degasification can be done by, for example, bubbling an inert gas such as $N_2$ or by performing a reduced pressure treatment. In the present invention, when the above solvent is used for a silver solution containing silver ions, it is preferable to use a solvent which does not show reducibility to the silver ions.

The silver solution in the embodiments is one obtained by dissolving or molecularly dispersing silver or the above silver compound in a solvent. Hereinafter, "dissolution and molecular dispersion" is simply referred to as "dissolution", unless otherwise noted. Further, the reducing agent solution in the present invention is preferably used by dissolving the above reducing agent in a solvent, but may be in another state as long as the above reducing agent is contained. In addition, on the condition that silver is dissolved, the silver solution or the reducing agent solution may contain a substance in a solid or crystal state, such as a dispersion and a slurry.

(Thin Film Space)

In an example of preferable embodiments for performing a continuous wet reduction reaction by continuously mixing the silver solution and the reducing agent solution in the present invention, silver microparticles are preferably precipitated by a continuous wet reaction by mixing the silver solution containing at least silver ions and the reducing agent solution containing at least a reducing agent in a thin film fluid in a reaction field which is a thin film space of 0.1 mm or less, for example, 0.1 μm to 50 μm, formed between at least two ring shaped disks in which at least one of them rotates relative to the other. However, the present invention is not limited to a method in which the silver solution and the reducing agent solution are mixed in the thin film fluid to precipitate silver microparticles. The present invention is not specifically limited as long as silver microparticles are continuously obtained by a wet reaction at 99% or more of a reduction rate from the above silver solution to the silver microparticles, wherein an average primary particle diameter of the silver microparticles is 100 nm to 1,000 nm and an average crystallite diameter relative to the average primary particle diameter of the silver particles is 80% or more.

(Principle of Increase of Crystallite Diameter Relative to Particle Diameter by Control of Reduction Reaction Rate in Thin Film Space)

A method of producing highly crystalline silver microparticles of the present invention by a continuous wet reaction in the thin film space, is explained as an example of preferable embodiments. The thickness of the thin film space is forced to 0.1 mm or less, for example, 0.1 μm to 50 μm, and a very wide flow field is formed in the radial direction of the disk, and thereby the diffusion direction can be macroscopically controlled (see FIG. 1). As seen in FIG. 1, the solution flowing from the rotation shaft side (inner side) to the disk outer peripheral side (outer side) is the main stream over the entire thin film space, forming a thin film fluid in the thin film space. Next, a solution other than the main stream solution is introduced from the opening laid on the ring shaped disc surface. Since the opening is located on the way from the inside to the outside of the thin film space, as shown in FIG. 1, the solution other than the main stream is diffused into the solution flowing in the thin film space as the main stream. Diffusion of the solution other than the main stream is promoted in the rotation direction and the radial direction of the ring shaped disc. Thereby, a microscopic diffusion can also be controlled by controlling the diffusion of the rotation direction and the radial direction of the ring shaped disc, in addition to controlling the diffusion of the rotation shaft direction. Namely, a solution flowing in the thin film space as the main stream is a solution to be diffused, and another solution other than the main stream is actively diffused in the solution to be diffused. In general, a shape of the opening is in most cases a concentric circular shape with the ring shaped disk for introducing the solution. FIG. 1 shows the case that the solution is introduced from the opening consisting of one hole in order to make the movement of the solution clear.

Figure 2:
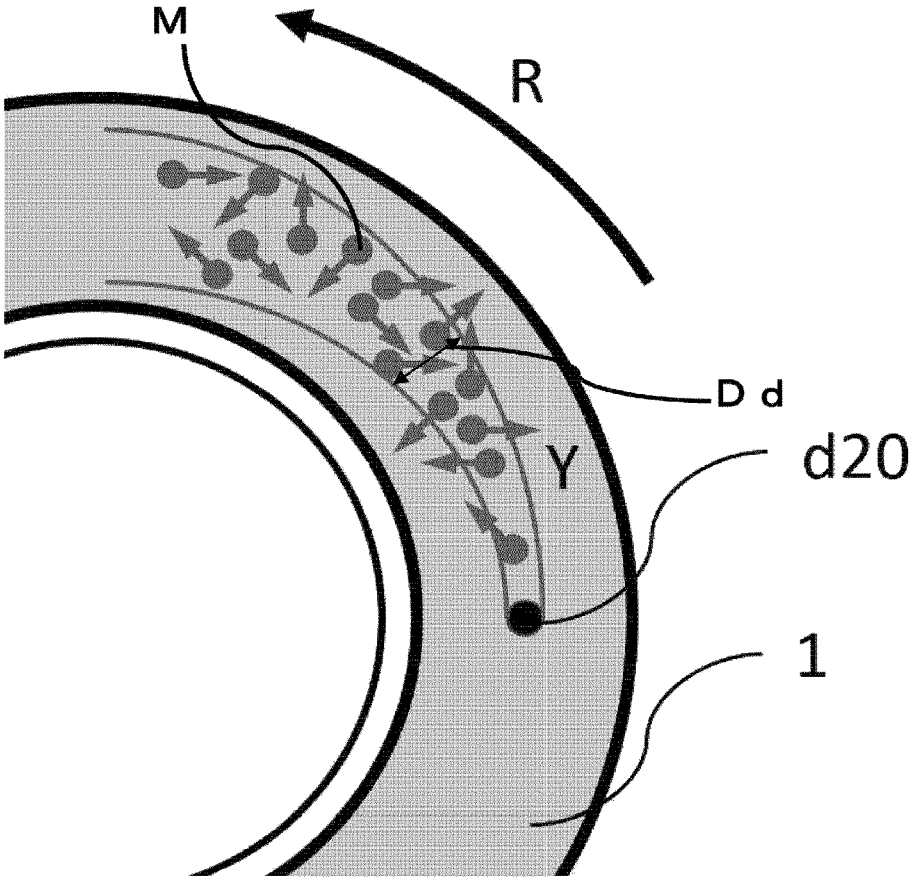
FIG. 2 shows a drawing showing the microscopic diffusion direction at a molecular level and the macroscopic diffusion direction in the reaction field in the thin film space.

In the above embodiment, the average crystallite diameter relative to the average primary particle diameter of the obtained silver microparticles is controlled by controlling the diffusion conditions in the thin film fluid of the thin film space. More specifically, the average crystallite diameter relative to the average primary particle diameter of the obtained silver microparticles is controlled by controlling the diffusion range Dd between the processing surfaces in the microscopically turbulent diffusion direction schematically shown by the arrow Y of the molecule M in the macroscopically controlled diffusion as shown in FIG. 2. In the present invention, the main stream is not limited to one flowing from the inside to the outside of the thin film space. It may flow from the outside to the inside of the disc, as long as it is the main stream in the thin film space. The solution other than the main stream may be introduced into the thin film fluid formed by the main stream, preferably from the downstream side of the main stream inlet. With regard to the introduction amount into the thin film fluid to maintain the relationship between the above main stream and the solution other than the main stream, the flow rate of the main stream solution relative to the flow rate of the solution other than the main stream is 1.1 times or more and 100 times or less by volume, preferably 1.3 times or more to 70 times or less by volume. Outside this range, the relationship between the main stream solution and the solution other than the main stream may be reversed, or it may be difficult to control the diffusion rate and to control the rate of the reduction reaction. The method of controlling the diffusion conditions, particularly controlling the diffusion range Dd between the processing surfaces is not particularly limited. For example, it is believed that the diffusion range Dd becomes smaller by increasing the rotation number, and thereby the arrow Y of the molecule M tends to be uniform in the rotation direction. Conversely, the diffusion range Dd becomes larger by decreasing the rotation number, and the arrow Y becomes turbulent in the radial direction of the processing surface. The flow rate of the solution introduced between the processing surfaces has different influences on the diffusion conditions depending on the flow rate ratio and the total flow rate. In particular, the flow rate of the solution other than the main stream relative to the flow rate of the main stream greatly affects the diffusion conditions, so the diffusion conditions can also be controlled by the thickness (distance) between the processing surfaces, the diameter of the opening disposed between the processing surfaces for introducing the fluid other than the main stream between the processing surfaces, in addition to the flow rate of the fluid introduced between the processing surfaces.

In the present embodiment, the diffusion rate of the reducing agent solution to the silver solution can be controlled by using a silver solution containing at least silver ions as the main stream and using a solution other than the main stream as the reducing agent solution. Namely, the rate of the reduction reaction can be controlled by controlling the diffusion time which can be said to be the time for collecting the reducing agent substance sufficient to precipitate the silver ions as silver microparticles around the silver ions contained in the silver solution, and then, the average crystallite diameter relative to the average primary particle diameter of the silver microparticles can be controlled. Conversely, when the reducing agent solution is the main stream and the solution other than the main stream is the silver solution, the silver solution is diffused into the reducing agent solution forming the main stream, and the silver ions are introduced into the area containing the reducing agent substance at a higher concentration as compared with the case of using the silver solution as the main stream, so that the reduction reaction of the silver ions is more likely to occur before the silver ions are diffused into the reducing agent solution. Therefore, since a large number of nuclei of silver microparticles are generated, the average crystallite diameter relative to the average primary particle diameter may decrease.

In the present embodiment, an apparatus for forming the reaction field of the thin film space, includes an apparatus using the same principle as the apparatus presented by the present applicant described in Patent Literatures 5 and 6. The distance between the at least two ring shaped disks for forming the thin film space is 0.1 mm or less, preferably in the range of 0.1 μm to 50 μm. By setting the distance to 0.1 mm or less, the diffusion direction can be controlled, and hence the reduction reaction rate can be controlled. Alternatively, the at least two ring shaped disks are preferably capable of approaching to and separating from each other, and the distance between the disks is preferably controlled by a pressure balance between a pressure in a direction to separate the disks by a fluid passing between the disks and a pressure in a direction to approach the disks. By controlling the distance between the disks by the pressure balance, the distance between the disks can be made constant even when a shaft vibration or a center runout caused by rotation of at least one of the ring shaped disks occurs. Therefore, there is an advantage that the diffusion conditions of the reaction field, that is, the rate of the reduction reaction of the silver ions and the reducing agent can be strictly controlled even during the continuous wet reduction reaction.

The present invention can be suitably performed as long as the temperature at the time of mixing of the silver solution and the reducing agent solution is not a temperature at which the solvent is not solidified or vaporized. The preferable temperature is, for example, 0 to 100° C., more preferably 5 to 80° C., still more preferably 10 to 70° C., particularly preferably 20 to 60° C. The temperature of each of the silver solution and the reducing agent solution can be appropriately set so that the temperature at the time of mixing falls within the above temperature range.

In the present embodiment, it is difficult to control the rate of the reduction reaction of silver ions in the thin film space, in the case of the silver solution containing a substance showing reducibility to silver. Therefore, preferably the silver solution does not substantially contain substances showing reducibility to silver. Specifically, it is preferable not to use a solvent showing reducibility to silver ions, such as a polyol solvent such as ethylene glycol and propylene glycol, as the solvent of the silver solution. However, it does not deny that the substance showing reducibility to silver such as the above mentioned polyol solvent is slightly contained, as long as the effects of the present invention are not affected, and silver microparticles having an average primary particle diameter of 100 nm or more and 1,000 nm or less and an average crystallite diameter of 80% or more respective to the average primary particle diameter can be obtained at a reduction rate of 99% or more. In the present invention, "substantially free of a reducing agent for silver" means as described above.

(Dispersing Agent and the Like)

In the present embodiments, various dispersing agents or surfactants may be used depending on a purpose or necessity. Not particularly limited, as a dispersing agent or a surfactant, various generally used commercial products or products, and newly synthesized products and the like may be used. Not particularly limited, a dispersing agent such as an anionic surfactant, a cationic surfactant, a nonionic surfactant, and various polymers and the like may be used. These may be used alone or two or more thereof may be used in combination. When a polyol solvent such as polyethylene glycol and polypropylene glycol is used as a solvent of the reducing agent solution, the polyol also acts as a dispersing agent.

(Effect of not Substantially Containing a Complexing Agent in the Silver Solution)

In general, a wet reduction reaction in the case of using ammonium as a complexing agent for silver ions is shown as an example, using the following formula (1), formula (2) and formula (3).

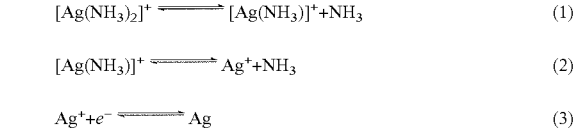

$$[Ag(NH_3)_2]^+ \rightleftharpoons [Ag(NH_3)]^+ + NH_3 \quad (1)$$

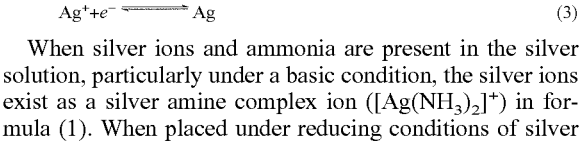

$$[Ag(NH_3)]^+ \rightleftharpoons Ag^+ + NH_3 \quad (2)$$

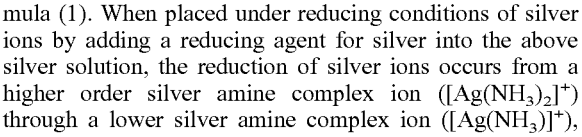

$$Ag^+ + e^- \rightleftharpoons Ag \quad (3)$$

When silver ions and ammonia are present in the silver solution, particularly under a basic condition, the silver ions exist as a silver amine complex ion ($[Ag(NH_3)_2]^+$) in formula (1). When placed under reducing conditions of silver ions by adding a reducing agent for silver into the above silver solution, the reduction of silver ions occurs from a higher order silver amine complex ion ($[Ag(NH_3)_2]^+$) through a lower silver amine complex ion ($[Ag(NH_3)]^+$), according to the equilibrium relationships of formulas (1) to (3). That is, in the case that the silver solution containing silver ions contains a complexing agent, not all silver ions undergo a reduction reaction immediately when the reducing agent is added. It is considered that the reaction to generate a silver ion from a silver amine complex ion at the second step does not occur only after silver microparticles to be seed crystals are precipitated, and that it difficult to efficiently use late generated silver ions for the growth of particles. Therefore, it is difficult to control the rate of the reduction reaction from the silver solution to silver microparticles by controlling the diffusion rate, and many seed crystals are generated and polycrystals are formed. For this reason, it is difficult to improve the average crystallite diameter relative to the average primary particle diameter. In general, a bond between a silver ion and the complexing agent is strong enough to reduce the reduction rate, so that preferably the reducing agent solution does not substantially contain the complexing agent in the method of producing silver microparticles of the present invention. Examples of the complexing agent for silver include ammonia, ethylenediamine and the like. By this, the diffusion rate in the reduction reaction by mixing the silver solution and the reducing agent solution in the thin film space can be controlled, and the rate of the instantaneously happening reduction reaction of the silver ion and the reducing agent can be controlled. Thereby, the reduction rate of silver ions is likely to be 99% or more. However, it does not deny that the complexing agent is slightly contained, as long as the effects of the present invention are not affected, and silver microparticles having an average primary particle diameter of 100 nm or more and 1,000 nm ore less and an average crystallite diameter of 80% or more respective to the average primary particle diameter can be obtained at a reduction rate of 99% or more. In the present invention, "substantially free of a complexing agent for silver" means as described above.

pH of the silver solution and the reducing agent solution used in the present invention is not particularly limited, and may be appropriately selected depending on the average primary particle diameter or the average crystallite diameter or the like of the target silver microparticles.

(Embodiments of Preferred Products)

Use of the production method of the present invention has an advantage that an average crystallite diameter relative to an average primary particle diameter can be controlled to increase, even in the case of particles having an average primary particle diameter of 100 nm or more and 1,000 nm or less which is difficult for crystallinity control. Silver microparticles having an average crystallite diameter of 80% or more relative to the average primary particle diameter can be obtained at a high reduction rate of 99% or more. Further, preferably, silver microparticles having an average crystallite diameter of 90% or more relative to the average primary particle diameter at a high reduction rate of 99% or more or substantially 100%.

(Analysis Method of Average Primary Particle Diameter of Silver Microparticles)

A method of analyzing the average primary particle diameter of silver microparticles in the present invention is not particularly limited. As an example, a method of measuring the particle diameter of silver microparticles with a transmission electron microscope (TEM), a scanning electron microscope (SEM) or the like and obtaining an average value of a plurality of particle diameters, and a measurement method with a particle size distribution measuring apparatus, a small angle X-ray scattering (SAXS) or the like, may be used.

(Analysis Method of Average Crystallite Diameter of Silver Microparticles)

A method of analyzing the average crystallite diameter of silver microparticles in the present invention is not particularly limited. As an example, a method of calculating the average crystallite diameter by using Scherrer's equation from the obtained half width of the diffraction peak and the obtained half width of the diffraction peak of the standard sample using X-ray diffraction analysis (XRD), and a method of calculating the average crystallite diameter by a method such as Rietveld analysis, may be used.

(Analysis Method of Reduction Rate)

A method of analyzing the reduction rate in the method of producing silver microparticles of the present invention is not particularly limited. A method of calculating the concentration of not reduced or precipitated silver ions by analyzing the concentration of silver ions remaining in the liquid by ICP analysis, fluorescent X-ray analysis, or ion chromatography, wherein the liquid is a supernatant obtained from centrifugal separation or a filtrate obtained by filtering with a filter from the liquid obtained after mixing the silver solution and the reducing agent solution and precipitating silver microparticles, may be used. In the present invention, the reduction rate is the value obtained by subtracting the molar concentration (%) of unreduced silver ions contained in the liquid after precipitation of silver microparticles from 100%.

EXAMPLE

Hereinafter, the present invention is explained by examples. However, the present invention is not limited to the examples shown below. Hereinafter, silver microparticles were produced in Example 1, Comparative Example 1, Example 2, Comparative Example 2, Example 3, and Comparative Example 3, and the ratio (d/D) of the average crystallite diameter (d) to the average primary particle diameter (D) of the obtained silver microparticles and the reduction rate were compared. Example 1 is the case where the silver solution of the present invention was the main stream in the thin film space between the ring shaped disks, and Comparative Example 1 is the case where the reducing agent solution was the main stream in the thin film space. Example 2 is the case where the silver solution of the present invention to which a complexing agent was not added was the main stream in the thin film space, and Comparative Example 2 is the case where the silver solution to which a complexing agent was added was the main stream in the thin film space. Example 3 is the case where the silver solution of the present invention was treated as the main stream in the thin film space, and Comparative Example 3 is the case where the silver solution of the present invention was treated in a batch.

Example 1

Figure 3:
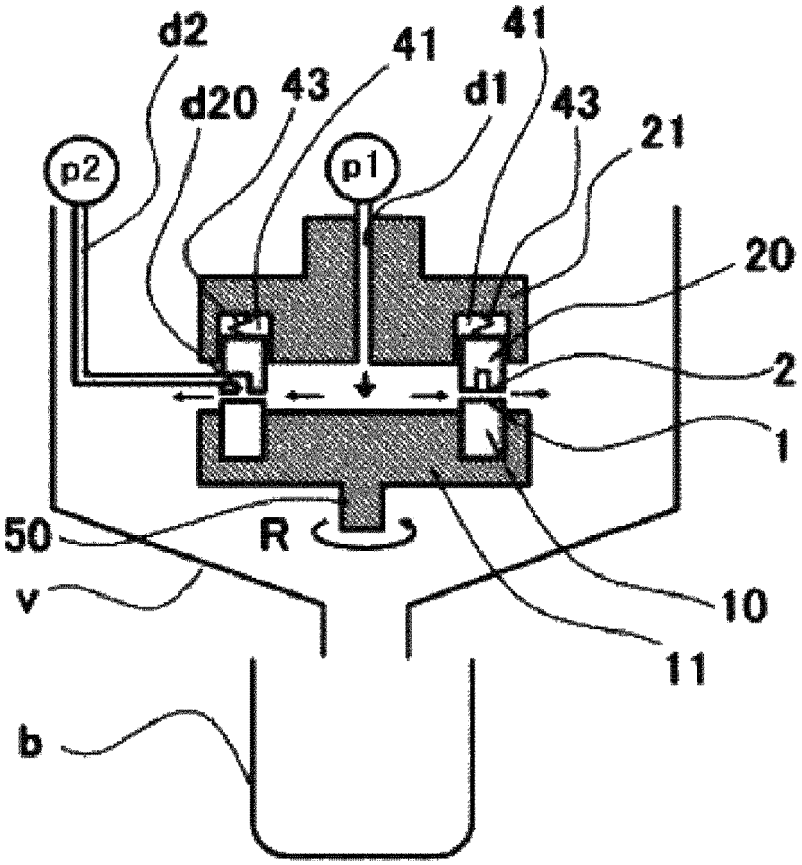
FIG. 3 shows a schematic chart of the fluid processing apparatus used in Examples of the present invention.

The silver solution and the reducing agent solution having formulations shown in Table 1 were mixed as the thin film fluid in the thin film space formed between the processing surfaces 1 and 2 disposed opposite to each other and being capable of approaching to and separating from each other in which at least one of the processing surfaces rotates relative to the other, using the fluid processing apparatus shown in FIG. 3 described in Patent Literatures 5 and 6, to precipitate silver microparticles in the thin film fluid. Specifically, the silver solution was sent from the center as the first fluid (main stream) at the supply pressure of 0.50 MPaG. The first fluid was sent to the thin film space sealed between the processing surface 1 of the processing part 10 and the processing surface 2 of the processing part 20 in FIG. 3 (between the processing surfaces). The rotation speed of the processing part 10 is shown in Table 2 as the operation conditions. The first fluid formed the thin film fluid forced between the processing surfaces 1 and 2, and was discharged from the outer periphery of the processing parts 10 and 20. The reducing agent solution was directly introduced into the thin film fluid formed between the processing surfaces 1 and 2 as the second fluid. The silver solution and the reducing agent solution were mixed between the processing surfaces 1 and 2 adjusted to a minute interval, to precipitate silver microparticles, and a slurry containing silver microparticles (silver microparticle dispersion) was discharged from the space between the processing surface 1 and 2 as a discharged liquid. The silver microparticle dispersion and silver microparticles dry powders obtained from the silver microparticle dispersion were analyzed.

[Preparation of the first fluid] The first fluid was prepared by dissolving $AgNO_3$ under a $N_2$ gas atmosphere in pure water in which the dissolved oxygen was reduced to 1.0 mg/L or less by bubbling $N_2$ gas.

[Preparation of the second fluid] The second fluid was prepared by dissolving $FeSO_4.7H_2O$ as a reducing agent under a $N_2$ gas atmosphere in pure water in which the dissolved oxygen was reduced to 1.0 mg/L or less by bubbling $N_2$ gas.

Regarding the abbreviations set forth in Table 1 to Table 8, $AgNO_3$ is silver nitrate (Kanto Kagaku Co., Ltd.), $FeSO_4.7H_2O$ is iron (II) sulfate heptahydrate (Wako Pure Chemical Industries, Ltd.), EDA is ethylene diamine (Kanto Kagaku Co., Ltd.), and Ag is silver. In addition, pure water having a pH of 5.89 and a conductivity of 0.51 μS/cm was used in Examples of the present invention. The prepared first fluid and second fluid were supplied under the conditions shown in Table 2 in Examples.

(Washing of Ag Microparticles)

The discharged silver microparticle dispersion was centrifuged (18,000 G, 20 minutes) to precipitate the silver microparticles. After removing the supernatant liquid, the operation of washing with pure water was performed three times. The obtained wet cake was dried at 25° C. at atmospheric pressure to prepare silver microparticle dry powders.

The following measurements and analysis were performed on the pH of the silver solution, the reducing agent solution and the silver microparticle dispersion, and the obtained silver microparticle dispersion and silver particle dried powders.

(pH Measurement)

For the pH measurement, the pH meter, model number D-51 (HORIBA Ltd.) was used.

A pH of the silver solution and the reducing agent solution was measured at room temperature prior to introduction of the respective solution into the fluid processing apparatus. Further, a pH of the silver microparticle dispersion, which was the discharged liquid, was measured at room temperature.

(Scanning Electron Microscope Observation: Calculation of Average Primary Particle Diameter)

For the scanning electron microscope (SEM) observation, a field emission scanning electron microscope (FE-SEM: JSM-7500F, JEOL Ltd.) was used. The observation condition was an observation magnification of 5,000 times or more. A maximum distance between two points on the outer periphery of the particle was measured to be a primary particle diameter. As an average primary particle diameter (D), a simple average value of the measured primary particle diameters of 100 silver microparticles observed by SEM observation was adopted.

(X-Ray Diffraction Measurement: Calculation of Average Crystallite Diameter)

For the X-ray diffraction (XRD) measurement to calculate an average crystallite diameter, the powder X-ray diffractometer X'Pert PRO MPD (XRD Spectris Co., Ltd., PANalytical Division) was used. The measurement condition was a measurement range of 10 to 100 [° 2Theta], Cu anticathode, tube voltage of 45 kV, tube current of 40 mA, and 0.016 step/10 sec. An average crystallite diameter of the obtained silver microparticles was calculated from the XRD measurement result. The peak observed at 47.3° was used from the XRD measurement result of the silicon polycrystals disc as a standard sample. The Scherrer equation was applied to the peak around 38.1° in the diffraction pattern of the obtained silver microparticles. From the above average primary particle diameter (D) and the average crystallite diameter (d), the ratio (d/D) of the average crystallite diameter (d) to the average primary particle diameter (D) was calculated by the following formula (4):

$$(d/D)=d/D\times 100[\%] \quad (4)$$

(ICP Analysis: Detection of Unreduced Elements)

ICPS-8100 (Shimadzu Corporation) was used for determination of the quantity of the elements contained in the discharged silver microparticle dispersion by inductively coupled plasma emission spectrometry (ICP). In addition, the tabletop ultracentrifuge MAX-XP (Beckman Coulter, Inc.) was used for an ultracentrifugation treatment. The supernatant obtained from the discharged silver microparticle dispersion (the supernatant obtained by centrifugation (18,000 G, 20 minutes) in the above washing of Ag microparticles) was subjected to ultracentrifugation (1,000,000 G, 20 minutes), and solid components were precipitated to obtain the supernatant. The molar concentration of unreduced silver ion in the obtained supernatant (Ag molar concentration), and the molar concentration of all silver and silver ions contained in the discharged liquid (total Ag molar concentration) were measured. Ag molar concentration relative to total Ag molar concentration was defined as unreduced silver [%], and the value obtained by subtracting unreduced silver [%] from 100% was defined as a reduction rate. The used atomic weight of silver was 107.9, and the used formula weight of silver nitrate was 169.87.

TABLE 1

| | Formulation of 1st fluid | | | Formulation of 2nd fluid | | |
|---|---|---|---|---|---|---|
| | Pure water | $AgNO_3$ | | Pure water | $FeSO_4 \cdot 7H_2O$ | |
| Example | Concentration [wt %] | | [pH] | Concentration [wt %] | | [pH] |
| 1 | 99.00 | 1.00 | 4.2 | 77.30 | 22.70 | 3.4 |
| 2 | 99.20 | 0.80 | 4.3 | 77.30 | 22.70 | 3.4 |
| 3 | 99.60 | 0.40 | 4.8 | 77.30 | 22.70 | 3.4 |

TABLE 2

| Example | Rotation number R [rpm] | 1st fluid Liquid sending flow rate [ml/min] | 1st fluid Liquid sending temperature [° C.] | 2nd fluid Liquid sending flow rate [ml/min] | 2nd fluid Liquid sending temperature [° C.] | Concentrations of respective raw materials in discharged liquid Pure water | $AgNO_3$ Concentration [wt %] | $FeSO_4 \cdot 7H_2O$ Concentration [wt %] | EDA Concentration [wt %] |
|---|---|---|---|---|---|---|---|---|---|
| 1 | 500 | 400 | 26 | 100 | 24 | 94.6600 | 0.8000 | 4.5400 | 0.0000 |
| 2 | 1000 | 300 | 25 | 100 | 25 | 93.7250 | 0.6000 | 5.6750 | 0.0000 |
| 3 | 2000 | 600 | 28 | 100 | 27 | 96.4143 | 0.3429 | 3.2429 | 0.0000 |

TABLE 3

| Example | Avarage primary particle diameter D [nm] | Average crystallite diameter d [nm] | Ag concentration in supernatant [wt %] | Ag molar concentration in supernatant [mol/L] | Total Ag molar concentration in dischared liquid [mol/L] | Reduction rate [%] | d/D [%] |
|---|---|---|---|---|---|---|---|
| 1 | 936.2 | 890.5 | 0.0015 | 0.0001390 | 0.0470948 | 99.7 | 95.12 |
| 2 | 862.7 | 796.6 | 0.0007 | 0.0000649 | 0.0353211 | 99.8 | 92.34 |
| 3 | 896.6 | 840.5 | 0.0023 | 0.0002132 | 0.0201835 | 99.5 | 93.74 |

Figure 4:
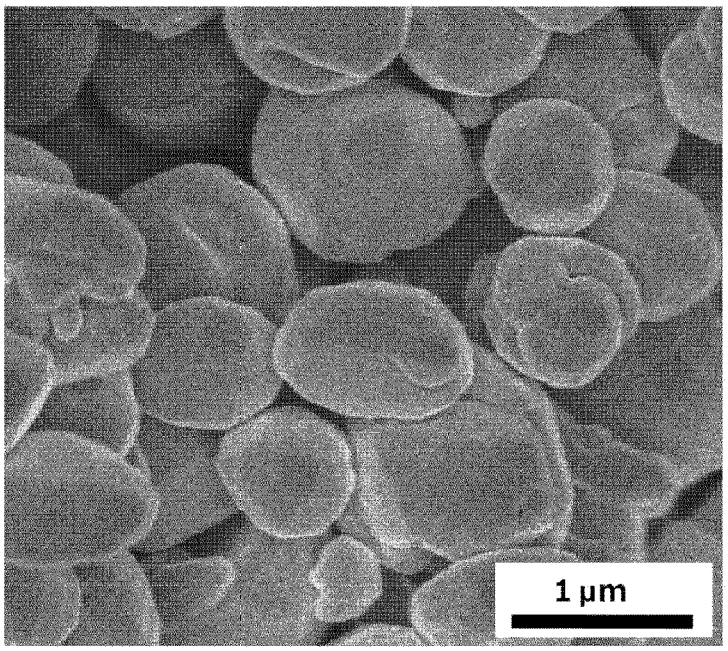
FIG. 4 shows an SEM photograph of the silver microparticles obtained in Example 1 of the present invention.
Figure 5:
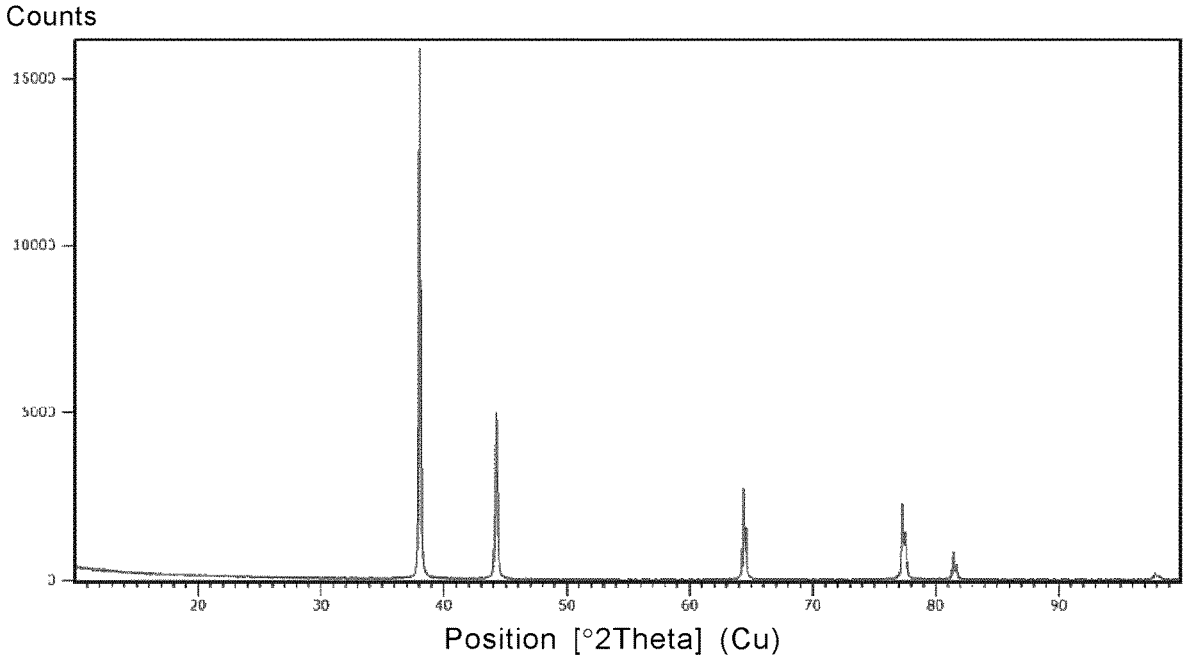
FIG. 5 shows an XRD measurement result of the silver microparticles obtained in Example 1 of the present invention.

The SEM photograph of the silver microparticles produced in Example 1 is shown in FIG. 4, and the diffraction pattern obtained by the XRD measurement is shown in FIG. 5. As shown in Table 3, by the formulation conditions and liquid sending conditions of Examples 1 to 3, it can be seen that the reduction rate was 99% or more, and the ratio (d/D) of the average crystallite diameter (d) relative to the average primary particle diameter (D) of the obtained silver microparticles was 80% or more, and furthermore even higher crystallinity of 90% or more could be realized.

Comparative Example 1

As shown in Table 5, Comparative Example 1 is an example in which the first fluid and the second fluid are replaced so that the concentrations of silver ions and the reducing agent in the discharged liquid are kept equal to those in Example 1. Silver microparticles were obtained using the fluid treatment apparatus shown in FIG. 3 in the same manner as in Example 1 except that the reducing agent solution and the silver solution having the formulations shown in Table 4 were mixed under the processing conditions shown in Table 5. The results are shown in Table 6. The supply pressure of the first fluid is as described above. Moreover, the replacement described here does not simply replace the silver solution of the main stream and the reducing agent solution other than the main stream. The main stream solution is changed by changing the concentration of raw materials and the processing flow rates so that the concentrations of silver ions and the reducing agent in the discharged liquid are equal before and after the replacement.

TABLE 4

| Comparative Example | Formulation of 1st fluid Pure water Concentration [wt %] | $FeSO_4 \cdot 7H_2O$ Concentration [wt %] | $AgNO_3$ Concentration [wt %] | EDA Concentration [wt %] | [pH] | Formulation of 2nd fluid Pure water Concentration [wt %] | $FeSO_4 \cdot 7H_2O$ Concentration [wt %] | $AgNO_3$ Concentration [wt %] | [pH] |
|---|---|---|---|---|---|---|---|---|---|
| 1 | 94.325 | 5.675 | 0.000 | 0.000 | 4.2 | 96.00 | 0.00 | 4.00 | 4.1 |
| 2 | 98.890 | 0.000 | 0.800 | 0.310 | 11.2 | 77.30 | 22.70 | 0.00 | 3.4 |
| 3 | 99.600 | 0.000 | 0.400 | 0.000 | 4.2 | 77.30 | 22.70 | 0.00 | 3.4 |

TABLE 5

| Example | Rotation number R [rpm] | 1st fluid Liquid sending flow rate [ml/min] | 1st fluid Liquid sending temperature [° C.] | 2nd fluid Liquid sending flow rate [ml/min] | 2nd fluid Liquid sending temperature [° C.] | Concentrations of respective raw materials in discharged liquid Pure water | $AgNO_3$ Concentration [wt %] | $FeSO_4 \cdot 7H_2O$ Concentration [wt %] | EDA Concentration [wt %] |
|---|---|---|---|---|---|---|---|---|---|
| 1 | 500 | 400 | 28 | 100 | 27 | 94.6600 | 0.8000 | 4.5400 | 0.0000 |
| 2 | 1000 | 300 | 24 | 100 | 25 | 93.4950 | 0.6000 | 5.6750 | 0.2300 |
| 3 | | | * | | | 96.4143 | 0.3429 | 3.2429 | 0.0000 |

* Omitted because of batch operation in Comparative Example 3

TABLE 6

| Comparative Example | Particle diameter D [μm] | Crystallite diameter d [μm] | Ag concentration in supernatant [wt %] | Ag molar concentration in supernatant [mol/L] | Total Ag molar concentration in dischared liquid [mol/L] | Reduction rate [%] | d/D [%] |
|---|---|---|---|---|---|---|---|
| 1 | 874.2 | 382.0 | 0.0087 | 0.0008063 | 0.0470948 | 98.3 | 43.70 |
| 2 | 651.4 | 72.1 | 0.0181 | 0.0016775 | 0.0353211 | 95.3 | 11.07 |
| 3 | 1264.1 | 682.5 | 0.0776 | 0.0071918 | 0.0201835 | 84.7 | 53.99 |

Figure 6:
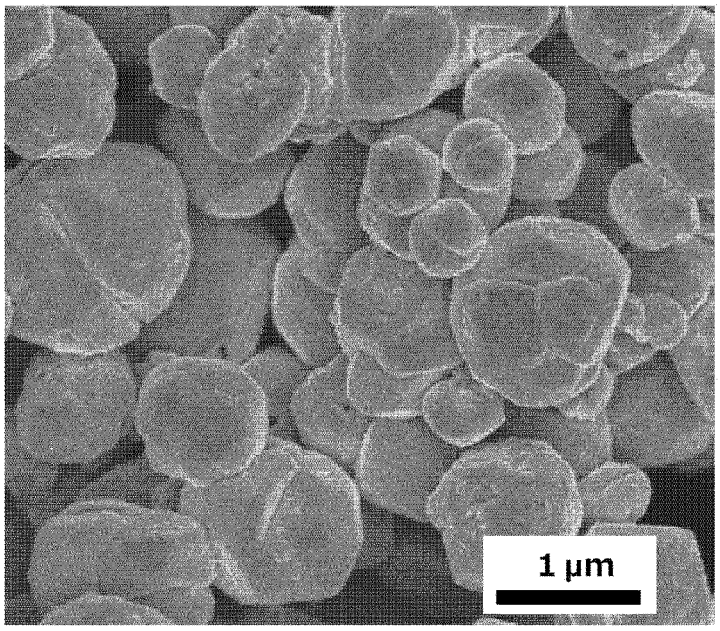
FIG. 6 shows an SEM photograph of the silver microparticles obtained in Comparative Example 1 of the present invention.
Figure 7:
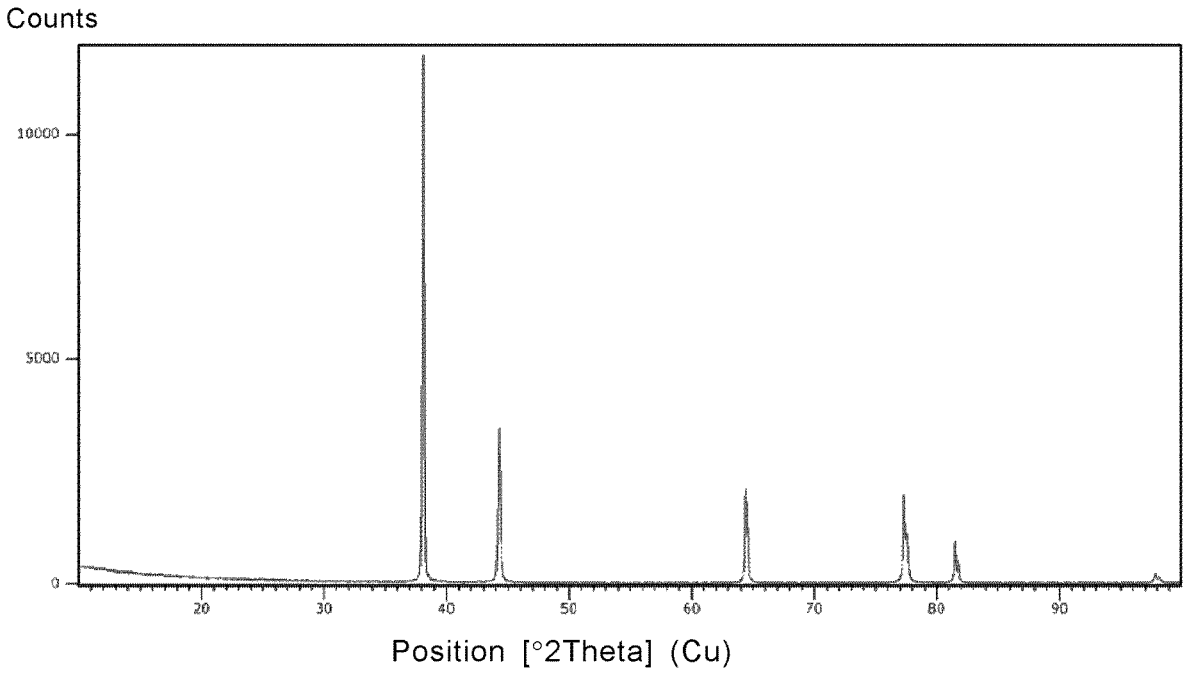
FIG. 7 shows an XRD measurement result of the silver microparticles obtained in Comparative Example 1 of the present invention.

The SEM photograph of the silver microparticles produced in Comparative Example 1 is shown in FIG. 6, and the diffraction pattern obtained by the XRD measurement is shown in FIG. 7. As shown in Table 6, the d/D was less than 80% and the reduction rate was also less than 99% in the silver microparticles obtained in Comparative Example 1. Shown is an example of replacing the main stream solution of the reducing agent solution and the silver solution so that the concentrations of the silver raw material and the reducing agent contained in the discharged liquid are equal as shown in Example 1 and Comparative Example 1. It has been found that the average primary particle diameter and the average crystallite diameter of precipitated silver microparticles can be controlled by using the silver solution as the main stream, and silver microparticles having 80% or more of the ratio (d/D) of the average crystallite diameter (d) to the above average primary particle diameter (D) can be produced.

Example 2

Silver microparticles were obtained using the fluid treatment apparatus shown in FIG. 3 in the same manner as in Example 1 except that the reducing agent solution and the silver solution having the formulations shown in Table 1 were mixed under the processing conditions shown in Table 2. The results are shown in Table 3.

As shown in Table 3, it can be also confirmed that silver microparticles having the d/D of 80% or more could be produced at the reduction rate of 99% or more by the conditions of Example 2.

Comparative Example 2

Comparative Example 2 is an example in which silver microparticles were obtained in the same manner as in Example 1 except that ethylene diamine was added to the first fluid as a complexing agent for silver, while the silver ions concentration in the first fluid and the reducing agent concentration in the second fluid were not changed from those in Example 2.

As shown in Table 6, it was found that the reduction rate was less than 99% and d/D was less than 80% by containing a complexing agent such as ethylene diamine as in Comparative Example 2.

Example 3

Silver microparticles were obtained using the fluid treatment apparatus shown in FIG. 3 in the same manner as in Example 1 except that the reducing agent solution and the silver solution having the formulations shown in Table 1 were mixed under the processing conditions shown in Table 2.

As shown in Table 3, it was also confirmed that silver microparticles having the d/D of 80% or more could be produced at the reduction rate of 99% or more by the conditions of Example 3.

Comparative Example 3

In Comparative Example 3, silver microparticles were obtained in the same manner as in Example 1 except that the first fluid and the second fluid in Example 3 were mixed in a batch operation in the same ratio as in Example 3. The silver solution and the reducing agent solution which were the same formulations as in Example 3 shown in Table 4 were prepared. While stirring with a magnetic stirrer, 10 mL of the reducing agent solution was added to and mixed with 60 mL of the silver solution in a beaker to precipitate silver microparticles. Thereafter, the silver microparticle dispersion and silver microparticle dry powders obtained from the silver microparticle dispersion were analyzed. The results are shown in Table 6.

As shown in Table 3, silver microparticles in which the average primary particle diameter and the average crystallite diameter of silver microparticles were controlled, and the ratio (d/D) of the average crystallite diameter (d) to the above average primary particle diameter (D) was 80% or more, were produced in Example 3. On the other hand, as shown in Table 6, the above d/D became less than 80% in Comparative Example 3 in which the solutions of the same formulations were mixed in a batch operation to precipitate silver microparticles.

Examples 4 to 6 and Comparative Examples 4 to 6

In Examples 4 to 6 and Comparative Examples 4 to 6, silver microparticles were obtained in the same manner as in Example 1 except that the liquid sending temperature and liquid sending flow rate of the silver solution and reducing agent solution in Example 1 and Comparative Example 1 were changed. Table 7 shows the formulation conditions in Examples 4 to 6, Table 8 shows the liquid sending conditions, and Table 9 shows the analysis results of the obtained silver microparticles. Table 10 shows the formulation conditions in Comparative Examples 4 to 6, Table 11 shows the liquid sending conditions, and Table 12 shows the analysis results of the obtained silver microparticles.

TABLE 7

| | Formulation of 1st fluid | | | Formulation of 2nd fluid | | |
|---|---|---|---|---|---|---|
| | Pure water | $AgNO_3$ Concentration [wt %] | | Pure water | $FeSO_4 \cdot 7H_2O$ Concentration [wt %] | |
| Example | | | [pH] | | | [pH] |
| 4 | 99.00 | 1.00 | 4.2 | 77.30 | 22.70 | 3.4 |
| 5 | 99.00 | 1.00 | 4.2 | 77.30 | 22.70 | 3.4 |
| 6 | 99.00 | 1.00 | 4.2 | 77.30 | 22.70 | 3.4 |

TABLE 8

| Example | Rotation number R [rpm] | 1st fluid Liquid sending flow rate [ml/min] | 1st fluid Liquid sending temperature [° C.] | 2nd fluid Liquid sending flow rate [ml/min] | 2nd fluid Liquid sending temperature [° C.] | Concentrations of respective raw materials in discharged liquid Pure water | $AgNO_3$ | $FeSO_4 \cdot 7H_2O$ | EDA |
|---|---|---|---|---|---|---|---|---|---|
| | | | | | | Concentration [wt %] | | | |
| 4 | 500 | 400 | 50 | 100 | 50 | 94.6600 | 0.8000 | 4.5400 | 0.0000 |
| 5 | 500 | 400 | 50 | 150 | 50 | 93.0818 | 0.7273 | 6.1909 | 0.0000 |
| 6 | 500 | 300 | 50 | 150 | 50 | 91.7666 | 0.6667 | 7.5667 | 0.0000 |

TABLE 9

| Example | Avarage primary particle diameter D [nm] | Average crystallite diameter d [nm] | Ag concentration in supernatant [wt %] | Ag molar concentration in supernatant [mol/L] | Total Ag molar concentration in dischared liquid [mol/L] | Reduction rate [%] | d/D [%] |
|---|---|---|---|---|---|---|---|
| 4 | 531.0 | 496.0 | 0.0010 | 0.0000927 | 0.0470948 | 99.8 | 93.41 |
| 5 | 389.0 | 377.0 | 0.0018 | 0.0001668 | 0.0428151 | 99.6 | 96.92 |
| 6 | 236.0 | 229.0 | 0.0004 | 0.0000371 | 0.0392477 | 99.9 | 97.03 |

As shown in Table 9, by the formulation conditions and liquid sending conditions of Examples 4 to 6, it can be seen that the reduction rate was 99% or more, and the ratio (d/D) of the average crystallite diameter (d) relative to the average primary particle diameter (D) of the obtained silver microparticles was 80% or more, and furthermore even higher crystallinity of 90% or more could be realized.

Comparative Examples 4 to 6

As shown in Table 10, Comparative Example 4 is an example in which the first fluid and the second fluid were replaced so that the concentrations of the silver raw material and the reducing agent contained in the discharged liquid were equal as shown in Example 4. Silver microparticles were obtained using the fluid treatment apparatus shown in FIG. 3 in the same manner as in Example 4 except that the reducing agent solution and the silver solution having the formulations shown in Table 10 were mixed under the processing conditions shown in Table 11. The results are shown in Table 12. As in Example 1 and Comparative Example 1, the silver solution of the main stream and the reducing agent solution other than the main stream were not simply replaced in the thin film space between the ring shaped disks. The main stream solution was changed by changing the concentration and the processing flow rates so that the concentrations of silver ions and the reducing agent in the discharged liquid were equal before and after the replacement.

TABLE 10

| Comparative Example | Formulation of 1st fluid Pure water | $FeSO_4 \cdot 7H_2O$ | $AgNO_3$ | EDA | [pH] | Formulation of 2nd fluid Pure water | $FeSO_4 \cdot 7H_2O$ | $AgNO_3$ | [pH] |
|---|---|---|---|---|---|---|---|---|---|
| | Concentration [wt %] | | | | | Concentration [wt %] | | | |
| 4 | 94.325 | 5.675 | 0.000 | 0.000 | 4.2 | 96.00 | 0.00 | 4.00 | 4.1 |
| 5 | 91.488 | 8.512 | 0.000 | 0.000 | 3.9 | 97.33 | 0.00 | 2.67 | 4.2 |
| 6 | 88.650 | 11.350 | 0.000 | 0.000 | 3.7 | 98.00 | 0.00 | 2.00 | 4.2 |

TABLE 11

| Comparative Example | Rotation number R [rpm] | 1st fluid Liquid sending flow rate [ml/min] | 1st fluid Liquid sending temperature [° C.] | 2nd fluid Liquid sending flow rate [ml/min] | 2nd fluid Liquid sending temperature [° C.] | Concentrations of respective raw materials in discharged liquid Pure water | $AgNO_3$ | $FeSO_4 \cdot 7H_2O$ | EDA |
|---|---|---|---|---|---|---|---|---|---|
| | | | | | | Concentration [wt %] | | | |
| 4 | 500 | 300 | 50 | 100 | 50 | 94.6600 | 0.8000 | 4.5400 | 0.0000 |
| 5 | 500 | 400 | 50 | 150 | 50 | 93.0818 | 0.7273 | 6.1909 | 0.0000 |
| 6 | 500 | 300 | 50 | 150 | 50 | 91.7666 | 0.6667 | 7.5667 | 0.0000 |

TABLE 12

| Comparative Example | Particle diameter D [μm] | Crystallite diameter d [μm] | Ag concentration in supernatant [wt %] | Ag molar concentration in supernatant [mol/L] | Total Ag molar concentration in dischared liquid [mol/L] | Reduction rate [%] | d/D [%] |
|---|---|---|---|---|---|---|---|
| 4 | 516.0 | 235.0 | 0.0086 | 0.0007970 | 0.0470948 | 98.3 | 45.54 |
| 5 | 399.0 | 246.9 | 0.0111 | 0.0010287 | 0.0428151 | 97.6 | 61.88 |
| 6 | 216.0 | 111.6 | 0.0216 | 0.0020019 | 0.0392477 | 94.9 | 51.67 |

As shown in Table 12, the silver microparticles obtained in Comparative Examples 4 to 6 had the d/D of less than 80% and the reduction rate of less than 99%. From the results of Examples 4 to 6 and Comparative Examples 4 to 6, it was found that the ratio (d/D) of the average crystallite diameter (d) to the average primary particle diameter (D) of the produced silver microparticles was 80% or more, by the main stream of the above silver solution.

As described above, it has been found that according to the present invention, silver microparticles having an average crystallite diameter of 80% or more relative to an average primary particle diameter can be continuously produced at a reduction rate of 99% or more. In the case where a silver paste is produced by using highly crystalline silver microparticles produced by the production method of the present invention and a conductor film is formed by using the silver paste, the conductor film has excellent heat shrinkage resistance, and smooth surface roughness of the conductor film. As described above, the present invention greatly contributes to improvement of the quality of the conductor formed by using the conductive paste and improvement of the efficiency in the production of the silver paste itself.

REFERENCE SIGNS LIST

1 First processing surface
2 Second processing surface
10 First processing part
11 First holder
20 Second processing part
21 Second holder
d1 First introduction part
d2 Second introduction part
d20 Opening part

The invention claimed is:

1. A method of producing highly crystalline silver microparticles by a reduction reaction, which comprises precipitating the silver microparticles by reacting a silver solution containing at least silver ions and a reducing agent solution containing at least a reducing agent in a reaction field by a continuous wet reduction method, wherein the silver microparticles are precipitated by mixing the silver solution and the reducing agent solution by introducing the silver solution into a thin film fluid formed between two processing surfaces disposed opposite to each other and being capable of approaching to and separating from each other in which at least one of the processing surfaces rotates relative to the other, as a main stream flowing from a rotation shaft side to a processing surfaces outer peripheral side; and by actively diffusing the reducing agent solution from an opening laid on the processing surface into the main stream of the silver solution, wherein the silver solution does not substantially contain a complexing agent for silver or a reducing agent for silver, a reduction rate from the silver solution to the silver microparticles is 99% or more;

an average primary particle diameter of the silver microparticles is 100 nm or more and 1,000 nm or less; and an average crystallite diameter relative to the average primary particle diameter of the silver microparticles is 80% or more.

2. The method of producing highly crystalline silver microparticles according to claim 1, wherein the average crystallite diameter relative to the average primary particle diameter of the silver microparticles is 90% or more.

* * * * *